United States Patent [19]

Saila

[11] Patent Number: 4,538,485

[45] Date of Patent: Sep. 3, 1985

[54] LOCKABLE PLIER TOOL

[76] Inventor: Tauno Saila, 10534 Penrose St., Sun Valley, Calif. 91352

[21] Appl. No.: 593,087

[22] Filed: Mar. 26, 1984

[51] Int. Cl.[3] ..... B25B 7/14

[52] U.S. Cl. ..... 81/336; 81/320; 81/322; 81/323; 81/337

[58] Field of Search ..... 81/415, 428, 318–340; 128/322, 321, 340; 29/215, 219, 220, 221

[56] References Cited

U.S. PATENT DOCUMENTS

| | | | |
|---|---|---|---|
| 1,108,737 | 8/1914 | Gajdos | 128/340 |
| 1,266,788 | 5/1918 | Gannaway | 29/221 |
| 1,651,998 | 12/1927 | Clerico | 29/221 |
| 1,830,855 | 11/1931 | Russell | 81/323 |

FOREIGN PATENT DOCUMENTS

| | | | |
|---|---|---|---|
| 192604 | 10/1957 | Fed. Rep. of Germany | 81/338 |

*Primary Examiner*—James L. Jones, Jr.

[57] ABSTRACT

A lockable plier-type tool having the lockable features selectively engageable and including handle flexibility and locking element positioning that enhances its gripping capabilities. The locking elements are also arranged and constructed so that the plier may conveniently be used in the conventional manner (i.e. without the locking feature) and may exhibit any desired jaw configuration.

4 Claims, 6 Drawing Figures

LOCKABLE PLIER TOOL

This invention relates, among other things, to a plier-type tool that is multi-faceted in its potential usage. In essence a conventional plier is modified to include locking features that may be selectively employed at the users convenience. More particularly, the invention contemplates conversion of the conventional plier to a lockable plier having suitable flexibility to lock-grip in engagement with typical unyielding elements. Furthermore, the structure contemplated assembles the locking elements substantially within the confines of the extent of the plier-handles so that conventional use of the plier is not impaired.

Pliers employing locking features have been available in the past but for-the-most part have been special purpose in nature, construction and concept. In particular, however, these prior art pliers have relied upon the flexibility and resiliency of the article grasped to enable positive and sure gripping of the locked plier. Accordingly, many elements for which pliers are typically employed, could not be effectively gripped. In some instances this resulted due to plier handle bulk (i.e. cross-sectional size or configuration) and in others due to positioning of the locking elements.

In addition, it is typical of the earlier locking plier arrangements that the locking elements protrude in various fashions from the plier handle boundaries. This has a further limiting effect on its use in that such makes the plier unwieldy in terms of the user being able to effectively hold it and position it in confined areas.

A principal object of the invention, therefore, is to provide a selectively engageable locking arrangement for a substantially conventional plier so that such can be lockingly engaged with typical plier-held elements. Another object is to provide a lockable plier that will be biased to its full-open position upon release of its locking feature. Still another object is to provide means to selectively retain the locking features in a non-functioning relationship.

Yet another object is to provide a stop element that assures retention of the locking features in their selectively engageable relationship. A still further object of the invention is to provide a plier locking feature that may be employed with a variety of jaw configurations.

Additional objectives and advantages of the plier-type tool contemplated by this invention will become more apparent from a reading of the appended specification, claims and drawings wherein:

Figure 1:
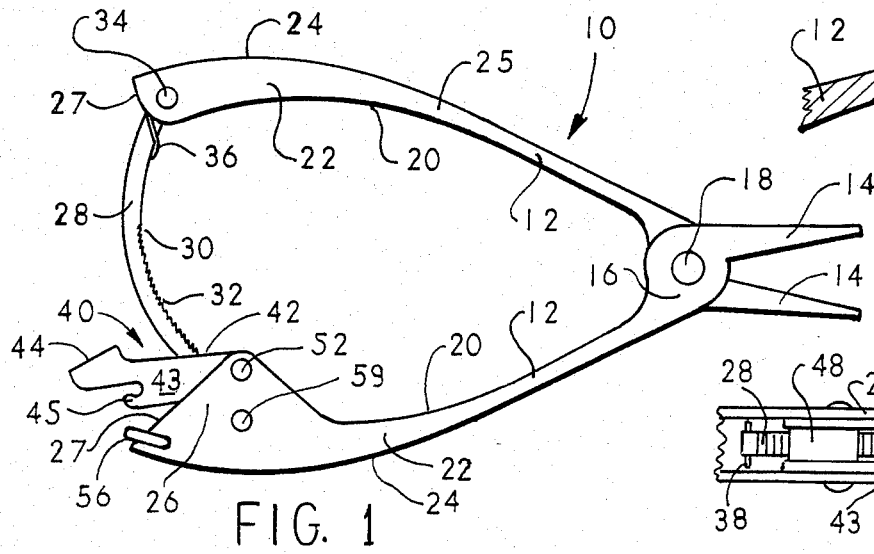
FIG. 1 is an elevational view of the plier-type tool illustrating a typical and preferred embodiment of the invention.

Referring now to FIG. 1 the plier-type tool 10 of this invention can be seen to include handles 12 and gripping jaws 14 that are joined by bosses 16. Each handle pair is further pivotally interconnected at the bosses 16 by the pivot pin 18. All of these elements are typical to conventional plier structures.

However, in the instant construction the handle extension 20 is preferably U-shaped in character and includes depending side walls or flanges 22 and connecting top wall 24. Furthermore, the portion 25 of the handles (FIGS. 2 and 6) may be altered in cross-sectional configuration as desired to lend flexibility to each handle. This feature will be discussed in more detail hereinafter. One of each handle pair 12 also includes a flange enlargement 26 adjacent its rearward extremity 27. These features are, of course, not typical of the conventional plier but in their usage here adapt the basic configuration for inclusion of the locking means.

Throughout it is noteworthy to understand that, although a single jaw 14 configuration is depicted, any plier jaw may be employed with equal success without affecting the intended operation of this plier.

Figure 2:
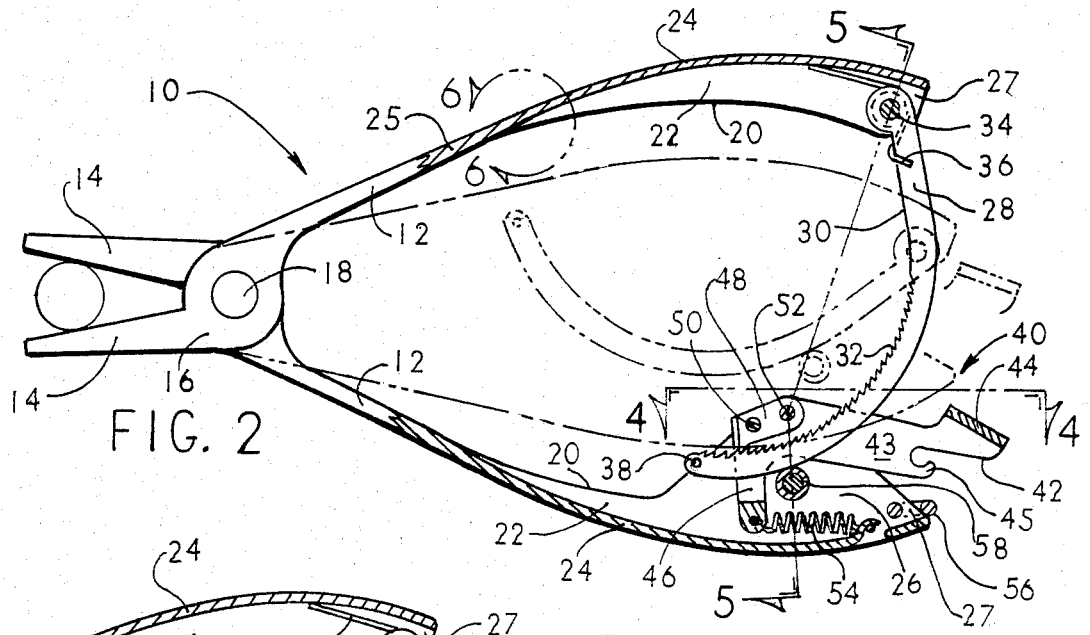
FIG. 2 is an elevational view similar to that of FIG. 1 and partially cut away to expose the locking features of the tool in its locked position while the phantom lines depict it in its fully closed position.
Figure 3:
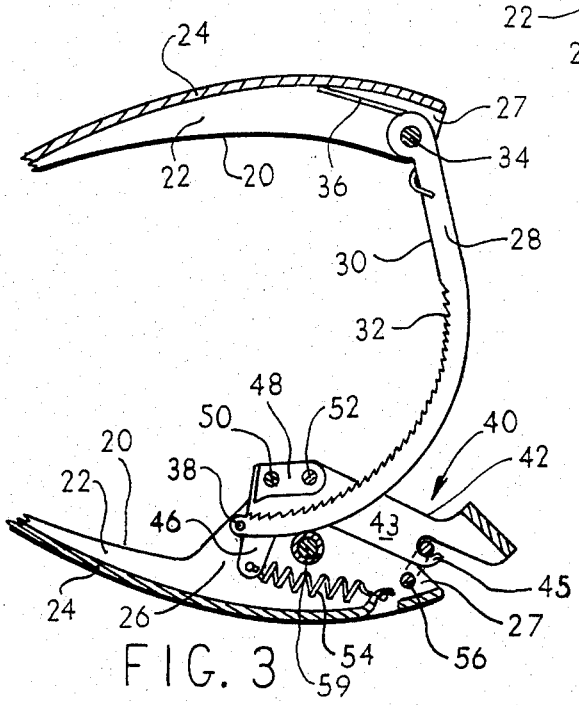
FIG. 3 is an enlarged partial view in cross-section of the plier locking features showing same positioned for non-locking use of the plier.
Figure 5:
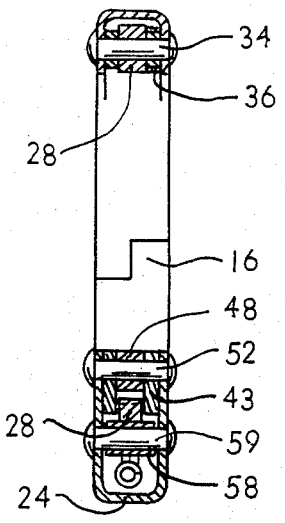
FIG. 5 is a cross-sectional view of the plier taken along line 5—5 of FIG. 2.

FIGS. 2 and 3 more clearly show the preferred locking mechanism arm or ratchet 28 having a surface 30 that is notched as at 32. The ratchet 28 is pivotally attached to one handle member 12 by pin member 34 adjacent its rearward extremity 27. Such is biased about pin 34 in a direction opposite jaws 14 by spring 36. Stop member 38 (pin) is suitably mounted in the free-end of arm 28 and interacts with latch 40 as is discussed below.

The latch 40 is comprised of a lever 42 that includes spaced walls 43 which walls are appropriately joined so as to form finger plate 44 and also display hook-like fingers 45 from their underside. The lever further incorporates depending extensions 46 that form an L-shaped offset from walls 43 and which are attached at their extremity. Latch 40 is completed by finger (pawl) 48 that is held between walls 43 and extensions 46 by rivet 50 or some equaivalent holding means.

Latch 40, furthermore, is pivotally positioned to that handle 12 which has the flange enlargement 26 by means of pin 52. A spring 54 preferably is connected to the extremity of extensions 46 and the rearward extremity 27 of handle extension 20. This biases the latch and, in particular the pawl 48 into engagement with ratchet 28 and effects plier locking. Note also that a lock ring 56 is affixed to rearward extremity 27 and may be selectively engaged with lever hook 45 to hold the pawl 48 out of engagement with arm 28 (FIG. 3). In this last mentioned configuration, the plier is, of course, ready to be employed in a conventional manner.

When the lever hook 45 and lock ring 56 are engaged stop member 38 will be positioned against extensions 46 in the full open position of the plier. This, accordingly, retains the locking mechanism in an operative relationship at all times. Further assurance of such relationship is maintained by employment of roller 58 that supports arm 28 in its proper position relative to latch 40. Roller 58 is sliding on pin 59.

Figure 6:
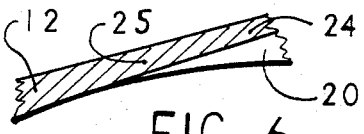
FIG. 6 is an enlarged partial view in cross-section taken along line 6—6 of FIG. 2 and illustrating an area of the handle members in which the material bulk may be selectively controlled to effect handle flexibility.
Figure 4:
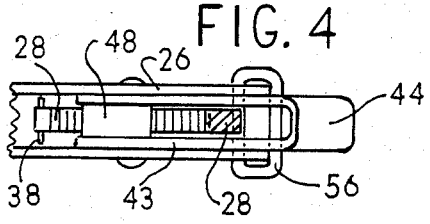
FIG. 4 is a partial view of the latch and pawl assembly of the plier taken along line 4—4 of FIG. 2.

It was noted above that flexibility of the handles 12 is significant to the effective of a locking plier. This arrangement contemplates that by a suitable selection of materials of construction and the positioning of ratchet 28 and pawl 48 at the rear extremity of the handles 12, flexibility requirements will be met. However, in the event additional flex is necessitated the cross-section configuration of handles 12 may be altered as seen in FIG. 6 to produce the necessary effect.

It should be understood that many changes could be made in carrying out the above constructions without departing from the scope of the invention, it is intended that all matter contained in the above description or shown in the accompanying drawings shall be interpreted as illustrative and not in a limiting sense.

I claim:

1. A plier-type tool adapted to retentatively grip an object and comprising a part of pivotally connected handles having oppositely protruding gripping jaws, one said handle having pivotally mounted thereon a ratchet, the other said handle having pivotally mounted thereon a pawl, said ratchet and pawl being separately spring biased away from the pivotal connection of said handles and that handle carrying said pawl includes means to retain the pawl out of engagement with said ratchet.

2. A plier-type tool according to claim 1 wherein said pawl incorporates a hook-like element and said means is a ring detachably engagable with said hook-like element.

3. A plier-type tool according to claim 1 wherein said arm is positioned and retained within the confines of said handle.

4. A plier-type tool according to claim 1 wherein said ratchet and said pawl are pivotally attached to said handles and said ratchet carries a stop member which assures a continued interrelationship of the ratchet with said pawl.

* * * * *